US005474482A

United States Patent [19]

Davidson

[11] Patent Number: 5,474,482

[45] Date of Patent: Dec. 12, 1995

[54] AERODYNAMIC ROTOR WITH CHEMILUMINESCENT LIGHT SOURCE HOLDER

[76] Inventor: Frankie G. Davidson, 3703 E. Monroe, Springfield, Mo. 65809

[21] Appl. No.: 239,294

[22] Filed: May 9, 1994

[51] Int. Cl.[6] ..... A63H 27/127; A63H 33/22

[52] U.S. Cl. ..... 446/41; 446/219

[58] Field of Search ..... 446/36–48, 219, 446/242; 273/DIG. 24

[56] References Cited

U.S. PATENT DOCUMENTS

| | | | |
|---|---|---|---|
| 811,784 | 2/1906 | Matteson | 446/38 |
| 3,704,540 | 12/1972 | Montagu | 446/40 |
| 4,044,499 | 8/1977 | Toler | 446/242 |
| 4,086,723 | 5/1978 | Strawick | 446/47 |
| 4,204,359 | 5/1980 | Plo | 446/41 |
| 4,207,702 | 6/1980 | Boatman et al. | 446/48 |
| 4,254,575 | 3/1981 | Gould | 446/46 |
| 5,083,799 | 1/1992 | Thill | 446/47 X |

FOREIGN PATENT DOCUMENTS

| | | | |
|---|---|---|---|
| 33106 | 4/1924 | Denmark | 446/42 |
| 63981 | 10/1955 | France | 446/41 |
| 1116470 | 5/1956 | France | 446/219 |
| 5228265 | 9/1993 | Japan | 446/47 |
| 11016 | of 1904 | United Kingdom | 446/42 |

*Primary Examiner*—Robert A. Hafer
*Assistant Examiner*—D. Neal Muir
*Attorney, Agent, or Firm*—Armstrong, Teasdale, Schlafly & Davis

[57] ABSTRACT

An aerodynamic rotor with pull-cord launcher toy adapted to attach a self-contained chemiluminescent light source to the rotor thereof, making the toy suited for use in the dark. The rotor includes one or more holders integrally formed into the blade(s) thereof for confining the light source therein. The light source is non-heat generating and creates a glowing shape of light when the rotor is launched and provides a source for locating the rotor when it lands. The rotor's shaft and the launcher's connector tube have an interconnecting design which enables them to easily be connected in the dark by feel. Some blades of the rotor have a small opening near their outer end to produce a whistling sound when the rotor is launched and rotates rapidly.

5 Claims, 5 Drawing Sheets

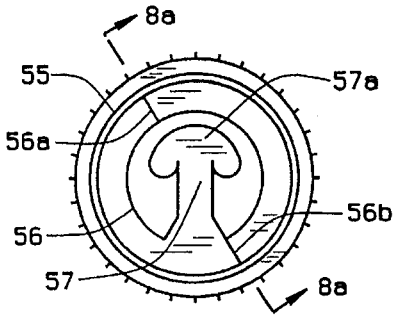
FIG. 8
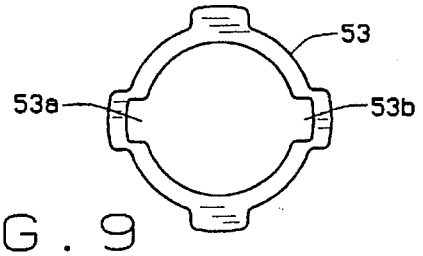
FIG. 9
FIG. 8a
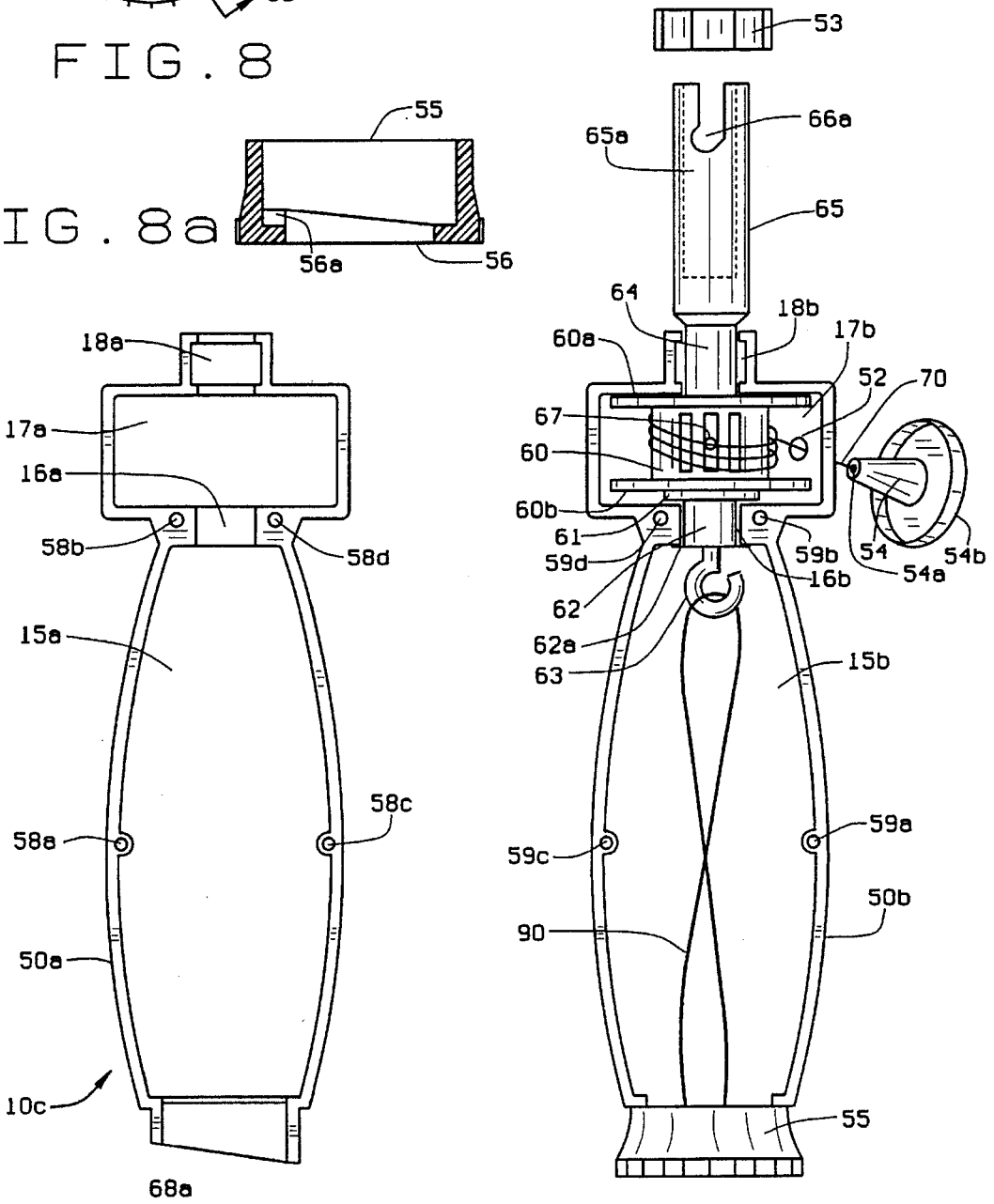
FIG. 10

AERODYNAMIC ROTOR WITH CHEMILUMINESCENT LIGHT SOURCE HOLDER

TECHNICAL FIELD

This invention relates to aerodynamic toys comprised of an aerodynamic item and a launching mechanism. In particular, this invention relates to a toy comprised of an aerodynamic rotor with an attachable shaft and a hand-held pull-cord launcher assembly, the rotor's shaft and the launcher's connector of which can easily be connected to each other in the dark, by feel, and the rotor of which has means thereon for attachment of a self-contained chemiluminescent light source thereto for the purpose of extending the toy's use into the non-daylight hours, outdoors, in the absence of artificial outdoor lighting, and for the purpose of creating a glowing shape of light which is formed and patterned by the direct light of the luminescent device in motion when the rotor is launched and rotates rapidly.

BACKGROUND ART

For decades a popular toy for outdoor use has been an item comprised of a rotor with an attachable shaft and a hand-held pull-cord launcher. The typical rotor is made of integrally molded plastic material which forms a system of pitched blades (airfoils) which converge horizontally to an axis to which the top of the rotor's shaft can be attached vertically from the bottom side of the rotor. The converging blades are equal and evenly distributed about the axis. An annular band extending continuously from the extreme outer end of one blade to that of the next forms the perimeter of the rotor and is concentrically positioned about the axis.

The typical hand-held pull-cord launcher is an assembly comprised of molded plastic components, a cord, a rubber band, and fasteners. The molded plastic components include two side walls which adjoin to form the side wall and bottom end of a hollow handle with an interconnecting circular compartment atop, referred to as the spool compartment. The spool compartment has an opening through the center of its top, the center of its bottom, and the center of its side wall. The compartment is designed to house a molded plastic spool which is integrally formed with a hook extending from the center of one of its flat circular ends and with a connector extending from the other, which is designed to connect the rotor's shaft to the launcher. The spool sits vertically, on end, inside the compartment with the hook extending through the opening in the bottom of the compartment and into the top portion of the hollow handle. The connector extends through the opening in the top of the spool compartment. One end of the cord attaches to the center of the side of the spool. The remainder of the cord winds clockwise around the spool and the opposite end of the cord exits the compartment through the opening in its side wall and attaches to a pull. The rubber band is attached to the hook, wound counterclockwise, stretched and connected to a rod which protrudes inward from the inner surface of the hollow handle, near its bottom end. The tension created in the rubber band keeps the cord wound onto the spool when the launcher is not in use. The side walls forming the side wall of the launcher are held together by screws or keeper rings.

The rotor is launched by grasping the handle with one hand, pointing the connector skyward, and, using the other hand, connecting the shaft attached to the rotor to the connector, grasping the pull, and rapidly pulling the cord, unwinding it from the spool. The unwinding action of the cord rotates the rubber band, the integrally formed hook/spool/connector composite component, and the rotor and its shaft counterclockwise, in unison, and creates lift beneath the horizontal rotating blades of the rotor. When the cord ceases to unwind, the rotating parts of the launcher cease to rotate. Simultaneously, momentum or inertia continues to rotate the rotor and its shaft and this force, combined with the lift created beneath the blades, causes the shaft to be released from the connector and sends the rotor and its shaft flying into the air, rotating about an axis of rotation while traveling generally perpendicular to that axis at the same time. When the cord is released, the increased tension in the wound rubber band is released and the unwinding action of the rubber band rotates the hook/spool/connector composite component clockwise and rewinds the cord onto the spool.

The typical aerodynamic rotor with pull-cord launcher toy has proven to be a suitable item for outdoor use during the hours of daylight. However, it is unsuited for outdoor use during non-daylight hours, in the absence of artificial outdoor lighting. The new invention makes the toy suitable for outdoor use during the hours of darkness, without artificial outdoor lighting.

The design of the typical aerodynamic rotor with pull-cord launcher toy is such that connecting the rotor's shaft to the launcher's connector is accomplished easily only when the interconnecting areas of the two approach each other at a precise angle, prior to making contact with each other. Such a connection is not easily accomplished in the dark or in insufficient light. The present invention provides a shaft and a connector which can easily be connected by feel, making the connection easily accomplished in the dark.

BRIEF DISCLOSURE OF THE INVENTION

It is an objective of this invention to provide an aerodynamic rotor with pull-cord launcher toy, the rotor of which has means thereon for attaching a self-contained chemiluminescent light source thereto for the purpose of extending the item's use into the non-daylight hours, outdoors, in the absence of artificial outdoor lighting, making the rotor easy to locate in the dark after it lands.

It is an objective of this invention to provide an aerodynamic rotor with pull-cord launcher toy, the rotor of which has means thereon for attaching a self-contained chemiluminescent light source thereto for the purpose of creating a glowing, circular light shape which is not simply an illuminated image of the item to which the luminescent device is attached, but a circular shape of light formed and patterned by the direct light of the luminescent device attached to the rotor in motion.

It is a further objective of this invention to provide an aerodynamic rotor with pull-cord launcher toy, the rotor's shaft and the launcher's connector of which can easily be connected in the dark, by feel.

Another objective of this invention is to provide an aerodynamic rotor with pull-cord launcher toy, the rotor of which has means thereon for producing a whistling sound when the rotor is launched and rotates rapidly.

In recent decades the public has become familiar with self-contained chemiluminescent light sources. The chemiluminescent light source used in conjunction with this toy is not a claim of this invention. However, a brief description of the embodiment of the luminescent device and how it produces light is appropriate U.S. Pat. No. 3,576,987 describes such a device as "a pair of reactant compounds, one of which is positioned in a thin glass tube and the other of which is positioned in a pliable plastic tube which completely surrounds the inner glass tube. . . . In order to mix the chemicals and provide a reaction which produces light, the outer plastic container is bent until the inner glass container breaks providing mixture of the compounds. The light source produced is non-heat generating and provides a strong light source for at least eight hours, with the source dissipating slowly thereafter."

The aerodynamic toy of the present invention is comprised of a molded plastic rotor with an attachable shaft and a pull-cord launcher assembly.

In its preferred embodiment, the aerodynamic rotor is made of an integrally molded plastic material which forms a system of pitched blades (airfoils) which converge horizontally to an axis ring. The converging blades are substantially equal and evenly distributed about the axis ring. An annular band extending continuously from the extreme outer end of one blade to that of the next forms the perimeter of the rotor and is concentrically positioned about the axis ring. A holder, incorporated into the manufacture of the rotor, provides means for attaching a self-contained chemiluminescent light source to a blade, making the item suitable for outdoor use in the dark, and for the purpose of creating a glowing, circular shape of light which is formed and patterned by the direct light of the luminescent device in motion, when the rotor is launched and rotates rapidly. The rotor may contain a multiple number of holders and they may be used simultaneously. The rotor has small rectangular openings positioned near the outer end of some of its blades. When the rotor is launched and rotates rapidly, air is compressed through the openings and a whistling sound is produced. A socket extends from the center of the axis ring, on the bottom side of the rotor, providing means for attaching the shaft to the rotor.

The rotor's attachable shaft is integrally formed of a moldable plastic material and its column has a tapered cylindrical shape. The top end of the column is substantially larger than the bottom end and has a rectangular prong extending from its center which fits firmly into the socket extending from the center of the rotor's axis ring. Two small cylinders protrude perpendicularly from the center of the column, opposite each other. The pull-cord launcher's connector is a cylindrical shaped hollow tube which has an even number of slots evenly positioned about the circumference of the upper portion of its side wall, at the open end of the tube. The diameter of the connector tube's opening is approximately twice as large as the diameter of the bottom end of the shaft's column. Connecting the rotor's shaft to the launcher's connector tube is easily accomplished by feel due to their size, shape, and interconnecting design. The connection is made by grasping the axis ring with one hand, with the shaft pointing downward, and, with the connector tube pointed skyward, grasping the slotted upper side-end portion of the connector tube between the thumb and forefinger of the other hand, overlapping them slightly across the open end of the tube, and using them as a guide to direct the bottom end of the shaft's column into the open end of the tube. Once accomplished, applying gentle downward twisting pressure to the axis ring will automatically seat the cylinders protruding from the center of the shaft's column to the bottom of two slots in the side wall of the connector tube, thereby readying the toy for launch.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

BRIEF DESCRIPTION OF THE DRAWINGS

FIG. 8 is a top view of the keeper ring that holds the bottom of the launcher's side wall together showing the inner surface of the bottom thereof, including the rim, and the arm extending therefrom, that partially closes the bottom thereof.

FIG. 8*a* is a sectional view taken substantially along line 5—5 of FIG. 8.

FIG. 9 is a top view of the key-way keeper ring showing the key-way grooves therein.

FIG. 10 is a partially exploded view of the side of the pull-cord launcher showing the positioning of the internal parts thereof, the positioning of connector tube thereof, and the interconnecting relationship of the components thereof.

DETAILED DESCRIPTION

Figure 1:
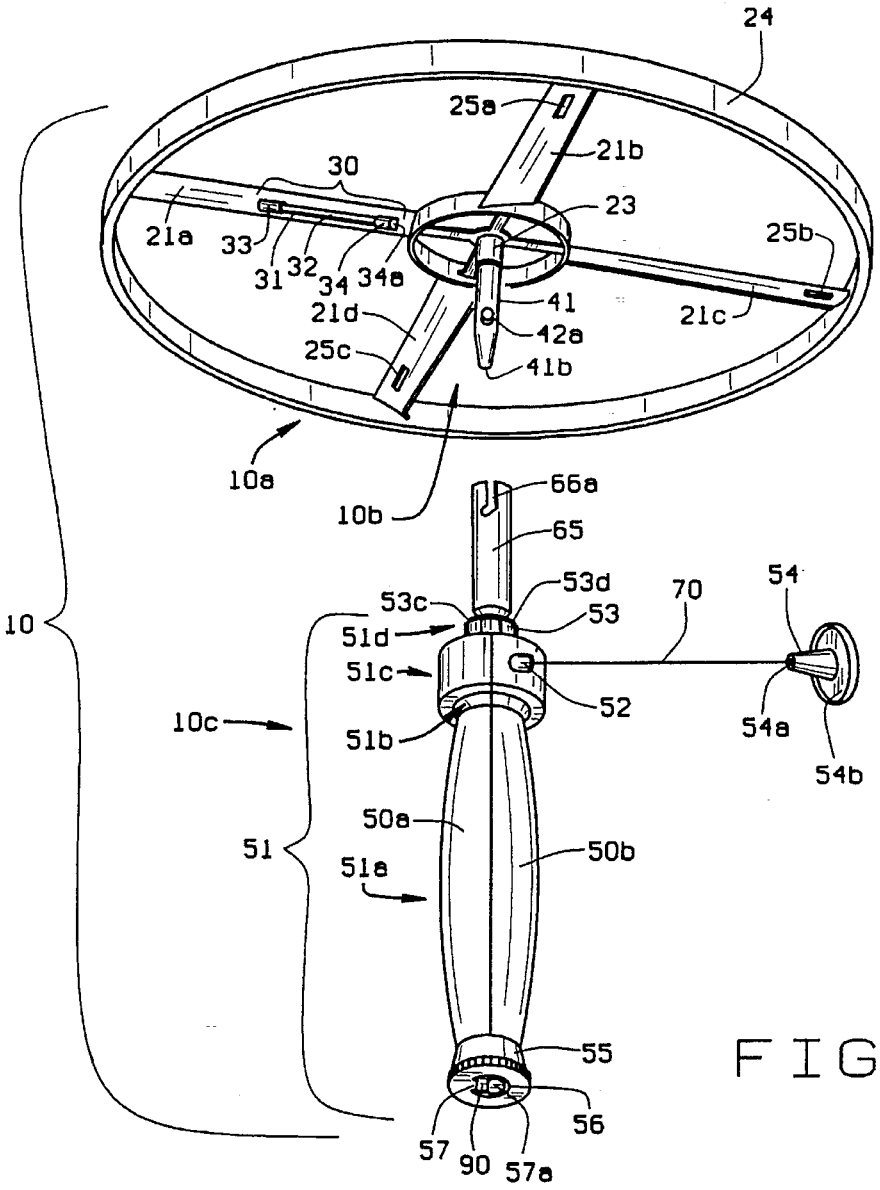
FIG. 1 is a perspective view of the toy showing the bottom side of the rotor and the holder for attaching the self-contained chemiluminescent light source to one of the blades thereof; the shaft attached to the rotor thereof; and the pull-cord launcher thereof.
Figure 4:
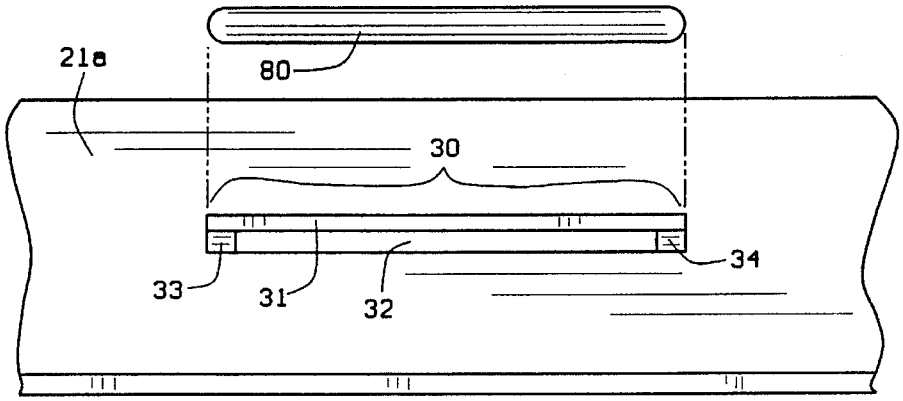
FIG. 4 is an enlarged perspective view of a portion of the top of the blade of the rotor having the holder integrally formed therein, showing the self-contained chemiluminescent light source used in conjunction therewith and lines indicating the direction by which the light source is inserted into and removed from the holder therein.
Figure 5:
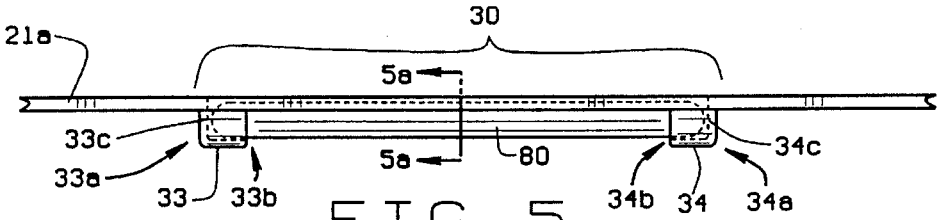
FIG. 5 is an enlarged detailed view of the side of the holder showing the self-contained chemiluminescent device inserted therein.
Figure 5A:
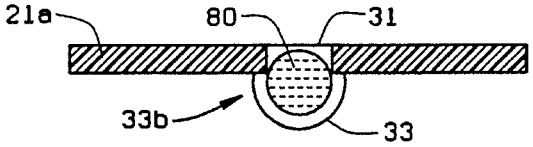
FIG. 5*a* is an enlarged sectional view taken substantially along line 4—4 of FIG. 5.

Referring to FIGS. 1 and 4, the aerodynamic rotor with attachable shaft and pull-cord launcher toy of the invention is indicated by the numeral 10. The toy 10 includes generally a molded plastic rotor 10*a* with an attachable shaft 10*b* and a hand-held pull-cord launcher assembly 10*c*. A holder 30, incorporated into the manufacture of the rotor 10*a*, provides means for attaching a self-contained chemiluminescent light source 80, used in conjunction with the toy 10, to the rotor 10*a*.

Figure 2:
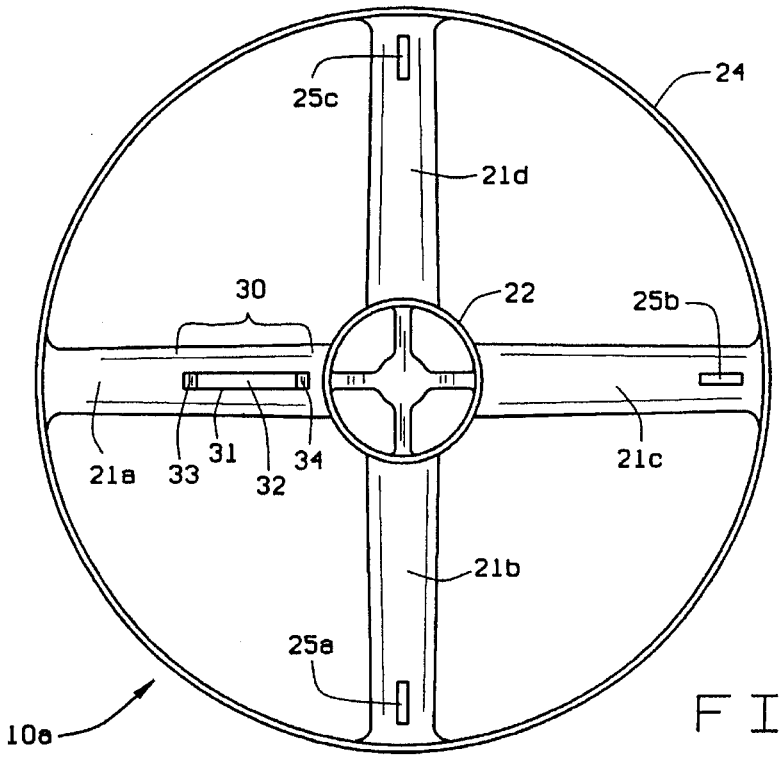
FIG. 2 is a perspective view of the top of the rotor showing a top view of the holder for attaching the self-contained chemiluminescent light source to one of the blades thereof.

Referring to FIGS. 1 and 2, in its preferred embodiment, the rotor 10*a* is constructed of integrally molded plastic material, such as polypropylene, which forms a system of pitched blades (airfoils) 21*a*, 21*b*, 21*c*, 21*d* which converge horizontally to an axis ring 22. The converging blades 21*a*, 21*b*, 21*c*, 21*d* are substantially equal and evenly positioned about the axis ring 22. An annular band 24 extending continuously from the extreme outer end of one blade 21*a* or 21*b* or 21*c* or 21*d* to that of the next blade 21*a* or 21*b* or 21*c* or 21*d* forms the perimeter of the rotor 10*a* and is concentrically positioned about the axis ring 22. When the rotor 10*a* is launched and rotates rapidly, air is compressed through the rectangular openings 25*a*, 25*b*, 25*c* near the outer end of some of the blades 21*b*, 21*c*, 21*d* and a whistling sound is produced. A socket 23 with a rectangular shaped inner surface extends perpendicularly from the center of the axis ring 22 and provides means for attaching the shaft 10*b* to the bottom side of the rotor 10*a*.

Figure 3:
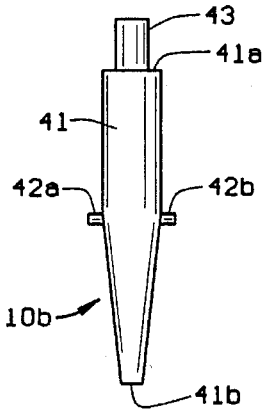
FIG. 3 is a side view of the shaft.
Figure 3A:
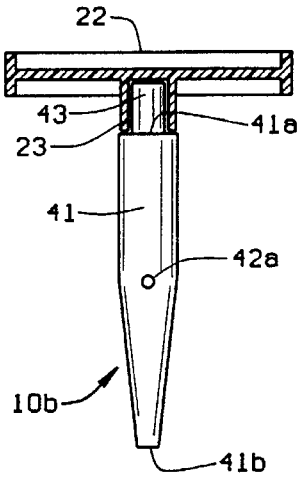
FIG. 3*a* is a sectional view of the axis ring of the rotor taken substantially along line 3—3 of FIG. 1 showing the top of the shaft inside the socket thereof.

Referring to FIGS. 1, 3, and 3*a*, the shaft 10*b* is integrally formed of a suitable moldable plastic material, such as delrin. The column 41 of the shaft 10*b* has a tapered cylindrical shape. The top half of the column 41 has a circumference that is constant and terminates with a flat circular end 41*a* which has a rectangular prong 43 extending from its center. The bottom half of the column 41 has a circumference that tapers and terminates with a flat circular end 41*b*. The diameter of the top end 41*a* is approximately twice as large as the diameter of the bottom end 41*b*. Two small cylinders 42*a*, 42*b* protrude perpendicularly from the center of the column 41, opposite each other. The prong 43 fits into the socket 23 protruding perpendicularly from the axis ring 22, thereby attaching the shaft 10*b* to the bottom side of the rotor 10*a* in tight friction-fit fashion.

FIGS. 1, 4, 5, and 5*a* illustrate the preferred embodiment of the new holder 30 for attaching the self-contained chemiluminescent light source 80, used in conjunction with the toy 10, to a blade 21*a* of the rotor 10*a*. The holder 30, integrally formed with the rotor 10*a*, is comprised of a border of material 31 framing an opening 32 through the center of the blade 21*a* and two "U-shaped" receptacles 33, 34 on the bottom side of the blade 21*a* positioned opposite each other, at opposing ends of the opening 32. The sides of the opening 32 run parallel to the side edges of the blade 21*a*. The length of the opening 32 is slightly longer than the length of the luminescent device 80. The width of the opening 32 is minutely smaller than the diameter of the device 80. Each receptacle 33, 34 has a closed end 33*a*, 34*a*, respectively, and an open end 33*b*, 34*b*, respectively. The inner surface 33*c*, 34*c* of each closed end 33*a*, 34*a*, respectively, is an extension of the border of material 31 framing an end of the opening 32. The open ends 33*b*, 34*b* of the receptacles 33, 34, respectively, face each other and are positioned in slightly closer spatial relationship to each other than the spatial relation of the distal ends of the luminescent device 80. The concave inner surface of each receptacle 33, 34 faces the opening 32, spanning the width of the opening 32.

The luminescent device 80 is inserted into the holder 30 from the top side of the rotor 10*a* by placing the device 80 on its side onto the border of material 31 framing the opening 32 and pressing on the side-end portions of the device 80 until it snaps through the opening 32 and the side-end portions of the device 80 seat to the bottom of the receptacles 33, 34.

Each receptacle 33, 34 holds a side-end portion of the device 80 and coacts with the border of material 31 framing the opening 32 to confine the majority of the device 80 beneath the bottom surface of the blade 21*a*, with the remainder of the device 80 being contained within the opening 32. Due to the design of the holder 30 only a small portion of the device 80 is concealed by confining material, allowing the direct light emitted by the device 80 to clearly be seen from the top, the side, and the bottom of the rotor 10*a*. When the rotor 10*a* is launched in the dark and rotates rapidly, the luminescent device 80 creates a glowing circle of light which is formed and patterned by the direct light emitted from the device 80 attached to the rotor 10*a* in motion. When the rotor 10*a* lands and ceases to rotate, the light from the device 80 makes the rotor 10*a* easy to locate in the dark. Neither the holder 30 nor the luminescent device 80 produces a substantial effect on the aerodynamic qualities of the rotor 10*a*. A multiple number of holders 30 may be incorporated into the manufacture of the rotor 10*a* and they may be utilized simultaneously.

Referring to FIGS. 1, 6, 7, 8, 8*a*, and 9, the pull-cord launcher assembly 10*c* is comprised of a cord 70, a rubber band 90, and components formed of a suitable moldable plastic material, such as ABS plastic material. The molded plastic components include two elongated side walls 50*a*, 50*b* which adjoin at their side edges to form the side wall 50 of a hollow housing 51 for the internal components of the launcher assembly 10*c*.

Another molded plastic component of the launcher assembly 10*c* is an integrally formed component which is a composite consisting of a spool 60 having a cylindrical shaped tube extension 64 with a slotted connector tube 65 atop extending, in sequence, from the center of one of its flat circular ends 60*a* and having a flat circular riser 61, a cylindrical shaped hook extension 62 with a rim 62*a*, and a hook 63 extending, in sequence, from the center of its other flat circular end 60*b*. The spool 60 has an opening 67 extending through the center of its side. Another plastic component is a hollow cone-shaped pull 54 with a sizeable rim 54*b* at its larger end and which has an opening 54*a* extending from end-to-end. The remaining plastic components include a key-way keeper ring 53 with two key-way grooves 53*a*, 53*b* and a keeper ring 55, one end of which is partially closed by a flat circular rim 56 which has a flat arm 57 with a flat bulbous end 57*a* extending into the diameter of its center. The rim 56 has protrusions 56*a*, 56*b* extending toward the opposite end of the keeper ring 55, angled in a counterclockwise direction.

Referring to FIGS. 1, 6, 7, 8, 8*a*, 9, and 10, the components forming the pull-cord launcher 10*c* are assembled in a systematic manner. The rubber band 90 is attached to the arm 57 of the keeper ring 55. One end of the cord 70 is inserted through the opening 67 in the center of the spool 60 and a knot is tied in it to keep it from passing back through the opening 67. The opposite end of the cord 70 is inserted through the chase 52 in the cavity 17*b* of side wall 50*b* and then through the opening 54*a* extending through the pull 54 and a knot is tied in it to keep it from passing back through the opening 54*a*. The cord 70 is then wound clockwise onto the spool 60 until it can no longer be wound and half of the riser 61, half of the spool 60 and half of its ends 60*a*, 60*b*, and half of a small portion of the tube extension 64 are drawn into cavity 17*b*, thereby positioning half of the hook 63 and half of the hook extension's rim 62*a* into cavity 15*b*;

half of the hook extension 62 into cavity 16*b;* half of the remainder of the tube extension 64 into cavity 18*b;* and half of the connector tube 65 directly above cavity 18*b*. The rubber band 90, which is already attached to the keeper ring 55, is attached to the hook 63; the keeper ring 55 is grasped and pulled, thereby stretching the rubber band 90 and creating tension in it; the bottom end 68*b* of the side wall 50*b* is placed inside the keeper ring 55, and the keeper ring 55 is released. The tension in the stretched rubber band 90 butts the inner surface of the rim 56 against the bottom end 68*b* of side wall 50*b*, thereby adjoining the two and holding the integrally molded composite component, consisting generally of the connector tube 65, the spool 60, and the hook 63, in place. Beginning with cavities 18*a*, 18*b*, side walls 50*a*, 50*b* are adjoined, including fitting the positioning pins 58*a*, 58*b*, 58*c*, 58*d* into their corresponding receptacles 59*a*, 59*b*, 59*c*, 59*d* and the bottom end 68*a* of side wall 50*a* inside the keeper ring 55. The key-way keeper ring 53 is passed over the connector tube 65, over the key-way tabs 53*c*, 53*d* and turned one-quarter of a turn, to disalign the key-way tabs 53*c*, 53*d* and the key way grooves 53*a*, 53*b*, thereby holding the top of the side wall 50 together. The bottom edge 68*a*, 68*b* of the side walls 50*a*, 50*b* are angled. When the side walls 50*a*, 50*b* are adjoined to form the side wall 50 of the launcher 10*c* the bottom edge 68 of the side wall 50 forms notches 69*a*, 69*b*. The protrusions 56*a*, 56*b* rising from the inner surface of the rim 56 of the keeper ring 55 and the notches 69*a*, 69*b* on the bottom edge 68 of the side wall 50 allow the keeper ring 55 to be turned only counterclockwise. Once assemblage of the launcher assembly 10*c* is completed, the keeper ring 55 is turned a few turns for the purpose of increasing the tension in the rubber band 90.

Figure 6:
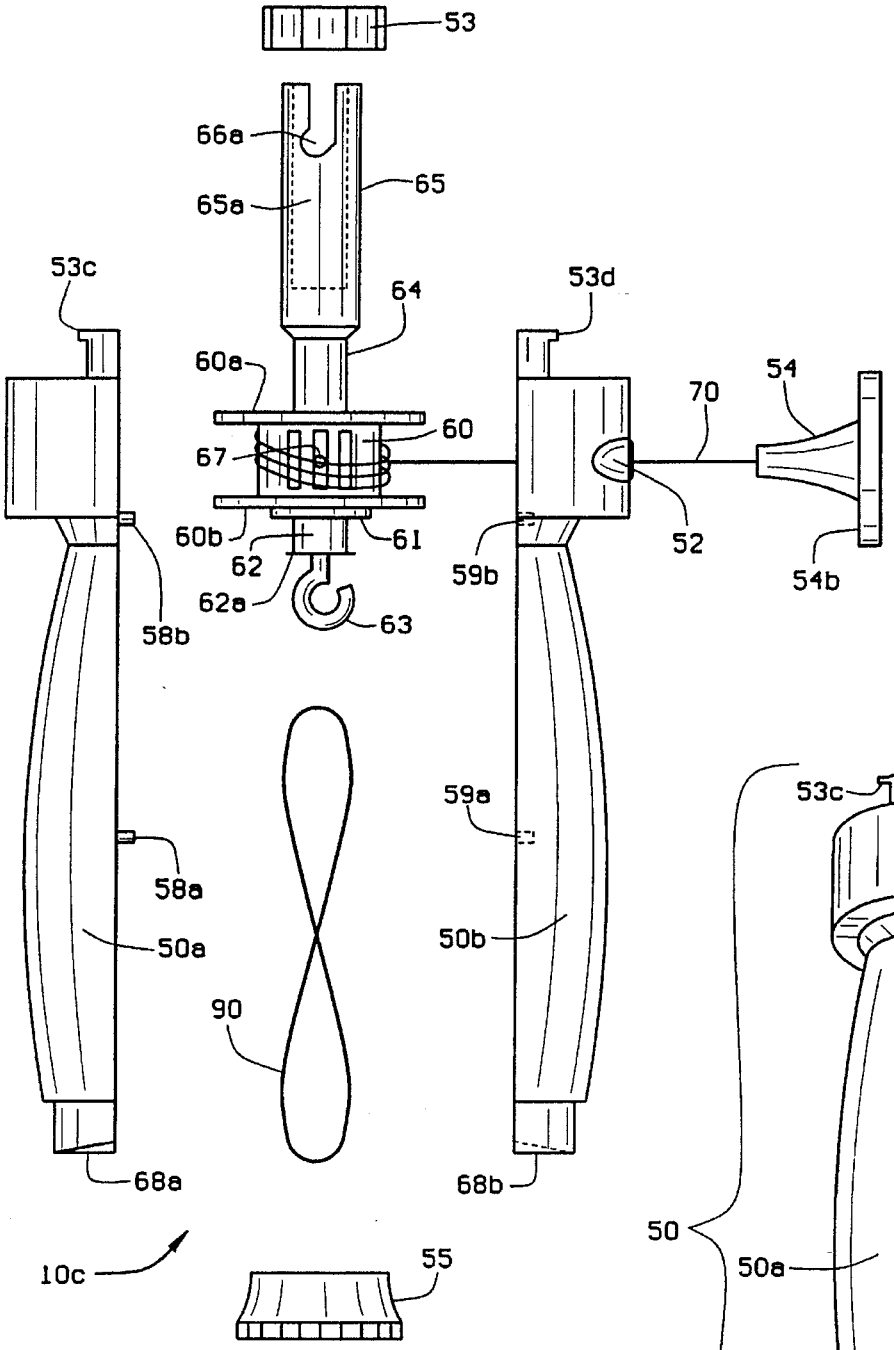
FIG. 6 is an exploded view of the pull-cord launcher showing a side view of the parts that combine to form the mechanism.
Figure 7:
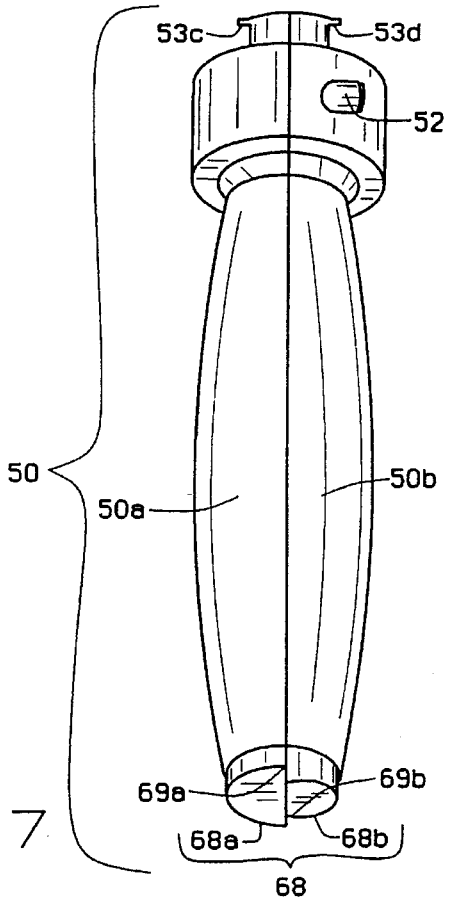
FIG. 7 is a perspective view of the side wall of the launcher, formed when the side walls of the launcher assembly are adjoined, showing the notches on the bottom edge thereof.
Figure 11:
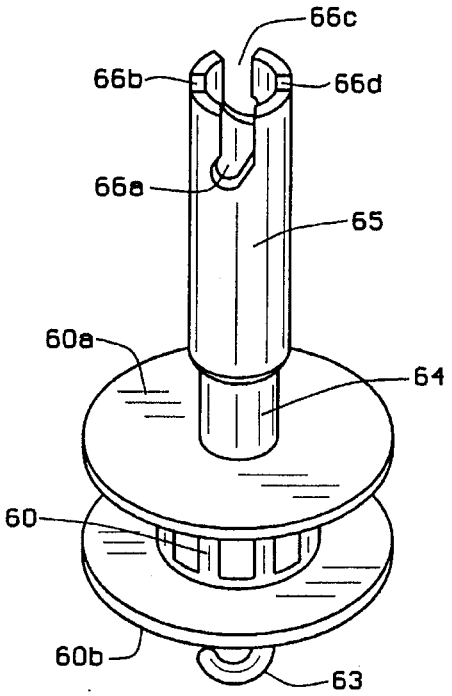
FIG. 11 is an enlarged perspective side view of the integrally formed hook/spool/connector tube composite component showing the open end of the tube and the slots in the upper portion of the side wall of the connector tube thereof.
Figure 12:
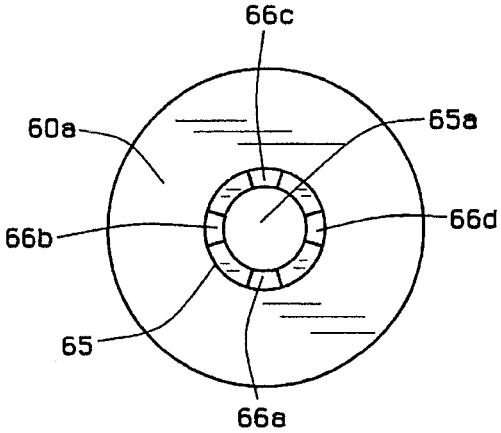
FIG. 12 is a top view of the integrally formed hook/spool/connector tube composite component showing the positioning of the slots in the upper portion of the side wall of the connector tube thereof and the hollow of the connector tube thereof.

Referring to FIGS. 1, 6, and 10, when adjoined as described, the side walls 50*a*, 50*b* and the keeper rings 53, 55 form an elongated housing 51 containing a series of interconnecting chases 51*a*, 51*b*, 51*c*, 51*d*, formed when the cavities 15*a*, 16*a*, 17*a*, 18*a* of side wall 50*a* are adjoined to the cavities 15*b*, 16*b*, 17*b*, 18*b* of side wall 50*b* and their locations of which are indicated by the major changes in the contour of the outer surface of the housing 51. The mass of material encircling chase 51*a* serves as a handle and houses the rubber band 90, the hook 63, and the hook extension's rim 62*a*. The mass of material encircling chase 51*b* houses the hook extension 62. The mass of material encircling chase 51*c* houses the riser 61, the spool 60, the spool's ends 60*a*, 60*b*, and a small portion of the tube extension 64. The mass of material encircling chase 51*d* houses the remainder of the tube extension 64. The connector tube 65 sits atop the housing 51. The inner surface of the material encircling chases 51*d* and 51*b* and the hook extension's rim 62*a* limit the lateral movement and the list of the tube extension 64 and the hook extension 62 to such degree that they do not stray significantly from the center of the housing 51, thereby limiting the lateral movement and the list of the spool 60 to such degree that its ends 60*a*, 60*b* do not rub against the inner surface of material encircling and framing chase 51*c*, when the cord 70 is pulled and the spool 60 rotates inside the chase 51*c*. The tension in the stretched rubber band 90 keeps the riser 61 butted against the surface of the material differentiating chase 51*c* from chase 51*b* and also keeps the cord 70 wound onto the spool 60 when the pull-cord launcher 10*c* is not in use.

FIGS. 1, 6, 11, 12, and 13, illustrate the preferred embodiment of the new connector tube 65 of the launcher 10*c*. The cylindrical shaped tube 65 has an even number of slots 66*a*, 66*b*, 66*c*, 66*d* evenly distributed about the circumference of the upper portion of its side wall, at the open end of the tube 65. The bottom of each slot 66*a*, 66*b*, 66*c*, 66*d* is angled and curved and is designed to partially encircle the circumference of one of the small cylinders 42*a*, 42*b* protruding from the column 41 of the shaft 10*b*. The diameter of the hollow 65*a* of the connector tube 65 is approximately twice as large as the diameter of the bottom end 41*b* of the shaft 10*b*. The shaft 10*b* is easily connected to the connector tube 65 by feel due to their size, shape and interconnecting design. The connection is made by placing the launcher 10*c* diagonally across the fingers of one hand in such fashion that the pad of the thumb and the pad of the forefinger can grasp the slotted upper side-edge of the connector tube 65 and partially overlap the open end of the tube 65, then, using the other hand, grasping the axis ring 22 from the top side of the rotor 10*a*, then placing the bottom end 41*b* of the shaft 10*b* between the pad of the thumb and the pad of the finger overlapping the open end of the tube 65, using them to guide the bottom end 41*b* of the shaft 10*b* into the top of the hollow 65*a* of the tube 65, and then applying gentle downward twisting pressure to the axis ring 22 until the small cylinders 42*a*, 42*b* protruding opposite each other from the center of the column 41 of the shaft 10*b* seat into two oppositely positioned slots 66*a*, 66*c*, or 66*b*, 66*d* of the connector tube 65. Once accomplished, the toy 10 is ready for launch.

Figure 13:
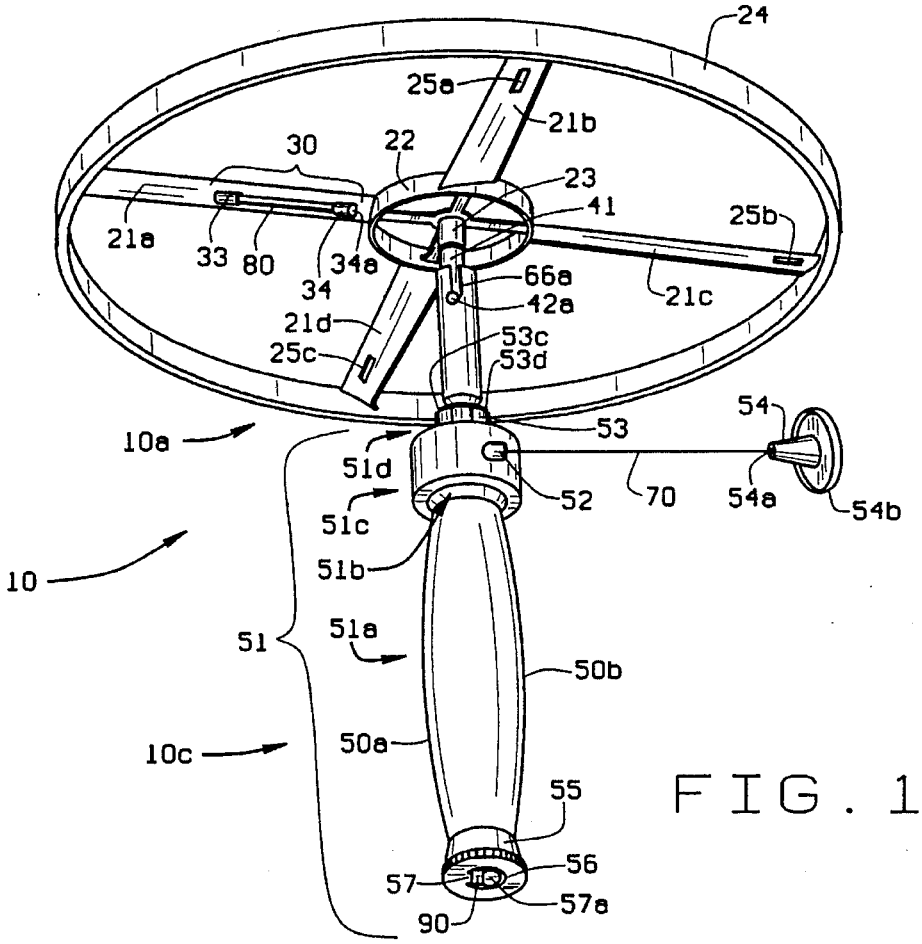
FIG. 13 is a perspective view of the toy prepared for launch, showing the chemiluminescent light source inside the holder of the blade of the rotor thereof.

Referring to FIGS. 1, 10 and 13, the rotor 10*a* and its shaft 10*b* are launched by grasping the handle 51*a* with one hand, pointing the connector tube 65 skyward, grasping the pull 54 with the other hand, and pulling the cord 70 rapidly, unwinding it from the spool 60. The unwinding action of the cord 70 rotates the rubber band 90, the hook 63/spool 60/connector tube 65 composite component, and the rotor 10*a* and its shaft 10*b* counterclockwise, in unison, and creates lift beneath the horizontal rotating blades 21*a*, 21*b*, 21*c*, 21*d*. When the cord 70 ceases to unwind, the rotating parts of the launcher 10*c* cease to rotate. Simultaneously, centrifugal force continues to rotate the rotor 10*a* and its shaft 10*b* and this force, combined with the lift created beneath the blades 21*a*, 21*b*, 21*c*, 21*d*, causes the shaft 10*b* to be released from the connector tube 65 and sends the rotor 10*a* and its shaft 10*b* flying into the air, rotating about an axis of rotation while traveling generally perpendicular to that axis at the same time. When the pull 54 is released, the increased tension in the wound rubber band 90 is released and the unwinding action of the rubber band 90 rewinds the cord 70 onto the spool 60.

While certain preferred embodiments of the present invention have been disclosed in detail, it is to be understood that various modifications in its structure may be adopted without departing from the spirit of the invention or the scope of the following claims. The present application is intended to cover all such modifications that fall within the basic underlying principles disclosed and claimed herein.

I claim:

1. An aerodynamic rotor with pull-cord launcher toy comprising in combination:

(a) a rotor, integrally formed and made of a moldable plastic material including a system of pitched blades, said blades converging horizontally to an axis ring and being evenly distributed about said axis ring;

an annular band extending continuously from the extreme outer end of one said blade to the enter end of the next said blade, said band being concentrically positioned about said axis ring and forming the perimeter of said rotor;

a socket having a rectangular inner surface, said socket protruding perpendicularly from the center of said axis ring, thereby indicating the bottom side of said axis ring, said blades, and said rotor;

wherein the improvement comprises:

a holder for attaching a self-contained chemiluminescent light source to one of said blades of said rotor, said holder being integrally formed therewith and including a border of material framing an opening through said blade and two receptacles on said bottom side of said blade, said receptacles being positioned opposite each other, at opposing ends of said opening, spanning the width of said opening;

(b) a shaft adapted for attaching to said socket of said axis ring of said rotor and for connecting to said pull-cord launcher;

(c) a pull-cord launcher;

wherein the improvement comprises:

a connector tube having a number of slots evenly distributed about the upper portion of its side wall, said connector tube being designed so said shaft can be connected to it by feel.

2. The aerodynamic rotor of claim 1 wherein openings are positioned in a plurality of said blades to produce a whistling sound when said rotor rotates rapidly.

3. The aerodynamic toy rotor according to claim 1 wherein the chemiluminescent light source is elongate, and wherein the holder holds the light source along the length of the blade.

4. The aerodynamic toy rotor according to claim 1 wherein the holder holds the chemiluminescent light source on the underside of the blade.

5. The aerodynamic toy rotor according to claim 4 wherein the holder comprises an elongate radially extending slot in the blade, and a receptacle at each end of the slot, the slot adapted to receive the top portion of an elongate chemiluminescent light source, and the receptacles adapted to receive and hold the ends of the light source.

* * * * *